US009843141B2

(12) United States Patent
Peng et al.

(10) Patent No.: US 9,843,141 B2
(45) Date of Patent: Dec. 12, 2017

(54) ELECTRICAL CONNECTOR

(71) Applicant: LOTES CO., LTD, Keelung (TW)

(72) Inventors: Jian Min Peng, Keelung (TW); Zhi Lin Chen, Keelung (TW)

(73) Assignee: LOTES CO., LTD, Keelung (TW)

( * ) Notice: Subject to any disclaimer, the term of this patent is extended or adjusted under 35 U.S.C. 154(b) by 0 days.

(21) Appl. No.: 15/639,158

(22) Filed: Jun. 30, 2017

(65) Prior Publication Data

US 2017/0302033 A1 Oct. 19, 2017

Related U.S. Application Data

(63) Continuation of application No. 15/386,372, filed on Dec. 21, 2016, now Pat. No. 9,728,899.

(30) Foreign Application Priority Data

Dec. 30, 2015 (CN) ..... 2015 2 1118161 U

(51) Int. Cl.

| | |
|---|---|
| ***H01R 13/6581*** | (2011.01) |
| ***H01R 24/64*** | (2011.01) |
| ***H01R 13/6597*** | (2011.01) |
| *H01R 107/00* | (2006.01) |

(52) U.S. Cl.

CPC ..... *H01R 13/6581* (2013.01); *H01R 13/6597* (2013.01); *H01R 24/64* (2013.01); *H01R 2107/00* (2013.01)

(58) Field of Classification Search

CPC ..... H01R 13/6581; H01R 13/6585; H01R 13/6593; H01R 13/6597; H01R 13/65802; H01R 24/64; H01R 2107/00

USPC ..... 439/607.27, 607.05, 607.34, 607.55, 95, 439/96

See application file for complete search history.

(56) References Cited

U.S. PATENT DOCUMENTS

| | | | | |
|---|---|---|---|---|
| 9,281,626 | B2 * | 3/2016 | Lin | H01R 13/6581 |
| 9,502,821 | B2 * | 11/2016 | Little | H01R 13/6582 |
| 9,728,899 | B2 * | 8/2017 | Peng | H01R 13/6581 |
| 9,761,973 | B2 * | 9/2017 | Tsai | H01R 12/716 |
| 2015/0340791 | A1 | 11/2015 | Kao et al. | |

OTHER PUBLICATIONS

U.S. Appl. No. 61/926,270 including Filing Receipt.

* cited by examiner

*Primary Examiner* — Tulsidas C Patel
*Assistant Examiner* — Travis Chambers
(74) *Attorney, Agent, or Firm* — Locke Lord LLP; Tim Tingkang Xia, Esq.

(57) ABSTRACT

An electrical connector used for mating a mating connector includes an insulating body having a base and a tongue extending from the base, a plurality of terminals fixedly disposed in the base portion in an upper row and a lower row, and a middle shielding sheet embedded in the tongue and located between the upper row and the lower row of terminals. The middle shielding sheet has a notch concavely formed on a front end of the middle shielding sheet and overlapping a central line of the middle shielding sheet along a longitudinal direction, at least one first projection portion extending from the notch, and at least one second projection portion extending from the notch. The first projection portion locates in front of the second projection portion, and the first projection portion is farther away from the central line of the middle shielding sheet than the second projection portion is.

19 Claims, 8 Drawing Sheets

ELECTRICAL CONNECTOR

CROSS-REFERENCE TO RELATED APPLICATION

This non-provisional application is a continuation application of U.S. application Ser. No. 15/386,372, filed Dec. 21, 2016, which itself claims priority to and the benefit of, under 35 U.S.C. §119(a), Patent Application No. 201521118161.7 filed in P.R. China on Dec. 30, 2015, the entire content of which is hereby incorporated by reference.

Some references, if any, which may include patents, patent applications and various publications, may be cited and discussed in the description of this invention. The citation and/or discussion of such references, if any, is provided merely to clarify the description of the present invention and is not an admission that any such reference is "prior art" to the invention described herein. All references listed, cited and/or discussed in this specification are incorporated herein by reference in their entireties and to the same extent as if each reference was individually incorporated by reference.

FIELD OF THE INVENTION

The invention relates to an electrical connector, and more particularly to an electrical connector capable of decreasing electromagnetic interference.

BACKGROUND OF THE INVENTION

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

In an existing electrical connector for transmitting high-frequency signals, it is common that electromagnetic interference will be generated between terminals, and how to solve and decrease electromagnetic interference has become an important topic researched by the industry.

For example, a newly emerging USB TYPE C connector includes an insulating body and two rows of terminals arranged in the insulating body. Each row of terminals include: a ground terminal, a pair of differential signal terminals for transmitting high-frequency signals, a power terminal, a reserved terminal, a pair of signal terminals, a reserved terminal, a power terminal, a pair of differential signal terminals for transmitting high-frequency signals, and a ground terminal. Since there are differential signal terminals for transmitting high-frequency signals in both the upper and lower rows of terminals of such a connector, during use, electromagnetic interference is prone to occur.

Therefore, a heretofore unaddressed need exists in the art to address the aforementioned deficiencies and inadequacies.

SUMMARY OF THE INVENTION

In one aspect, the present invention relates to an electrical connector that has decreased electromagnetic interference.

In certain embodiments, an electrical connector includes an insulating body, a middle shielding sheet arranged in the insulating body, at least one row of terminals arranged in the insulating body and located on one side of the middle shielding sheet, an inner metal shell at least partially enclosing the terminals and the middle shielding sheet, and an outer metal shell enclosing the insulating body and the inner metal shell to form a mating cavity. The at least one row of terminals includes at least one ground terminal. The ground terminal protrudes laterally to form an urging portion. The inner metal shell is in contact with the plate edge of the urging portion.

In certain embodiments, the urging portion is connected with the inner metal shell by spot welding.

In certain embodiments, among the row of terminals, the outermost terminals located at both sides are ground terminals. A sheet metal is blanked to form the ground terminals, the urging portions are integrally formed during blanking, and the plate edges of the urging portions are in contact with the inner wall of the inner metal shell. The insulating body includes a base and a tongue extending from the base, and the urging portions are located at least partially in the base. Each ground terminal has a main body located in the base, and the urging portion extends outward from the main body along a direction perpendicular to the main body.

In certain embodiments, the inner metal shell is provided with a sidewall buried in the insulating body, and the urging portions are in contact with the sidewall in the insulating body. The inner metal shell is also provided with a sidewall exposed outside the insulating body, and the urging portions protrude out of the insulating body to be in contact with the sidewall.

In certain embodiments, the electrical connector further includes an upper insulator and a lower insulator. One row of terminals are insert-molded into the upper insulator to form a first terminal module. The other row of terminals are insert-molded into the lower insulator to form a second terminal module. The insulating body is formed by the first terminal module, the second terminal module, and the middle shielding sheet by insert molding again, and the insulating body wraps the first terminal module, the second terminal module and the middle shielding sheet.

In certain embodiments, both sides of the middle shielding sheet are respectively protruded laterally to form a contact portion to be in contact with the inner metal shell. The contact portions are integrally formed when a sheet metal is blanked, and the plate edges of the contact portions urge against the inner wall of the inner metal shell.

In another aspect, the present invention relates to an electrical connector. In certain embodiments, an electrical connector includes an insulating body extending along the longitudinal direction, an inner metal shell fixed on the insulating body, a plurality of terminals arranged on the insulating body, and an outer metal shell, enclosing the insulating body and the inner metal shell to form a mating cavity. The plurality of terminals includes a ground terminal. The ground terminal is horizontally protruded outward to form an urging portion. The urging portion is in contact with the inner metal shell.

In certain embodiments, the urging portion is connected with the inner metal shell by spot welding. A sheet metal is blanked to form the ground terminals, the urging portions are formed integrally during blanking, and the plate edges of the urging portion are in contact with the inner wall of the inner metal shell. Each ground terminal has a main body extending along the longitudinal direction, and the urging portion extends perpendicular to the main body, and is coplanar with the main body. The insulating body includes a base and a tongue extending from the base. The inner metal shell has an annular portion fixed on the base and two covering portions extending from the annular portion and respectively covering the upper and lower surfaces of the tongue. The urging portions rigidly urge against the inner wall of the annular portion. The plurality of terminals are arranged in an upper row and a lower row, a middle shielding sheet is arranged between the two rows of terminals, and the plate edges of both sides of the middle shielding sheet are respectively projected horizontally to be in rigid contact with the inner metal shell.

In another aspect, the present invention relates to an electrical connector used for mating a mating connector, which includes an insulating body having a base and a tongue extending from the base, a plurality of terminals fixedly disposed in the base portion and arranged in an upper row and a lower row, a middle shielding sheet embedded in the tongue and located between the two rows of terminals. A notch is formed on the front end of the middle shielding sheet, and overlaps a central line of the middle shielding sheet along the longitudinal direction. At least one first projection portion and at least one second projection portion extend from the notch, the first projection portion is located in front of the second projection portion, and the first projection portion is farther away from the central line than the second projection portion is.

In certain embodiments, the first projection portion is located in the notch and extends from the front end of the middle shielding sheet toward the central line.

In certain embodiments, the tongue has an upper surface and a lower surface which are arranged opposite from each other, a front surface is connected to the upper surface and the lower surface, the upper row of terminals are exposed on the upper surface, the lower row of terminals are exposed on the lower surface, and the first projection portion is exposed on the front surface.

In certain embodiments, the at least one first projection portion includes two first projection portions that are arranged on two sides of the central line, respectively.

In certain embodiments, the distance between each of the first projection portions and the second projection portion is less than the distance from each of the first projection portion to the central line.

In certain embodiments, the two first projection portions are arranged in symmetry relative to the central line.

In certain embodiments, the at least one second projection portion includes a plurality of the second projection portions that are arranged in symmetry relative to the central line.

In certain embodiments, each row of terminals include a pair of signal terminals, the at least one second projection portion includes a plurality of second projection portions, and the second projection portions and the signal terminals are arranged to vertically correspond with each other.

In certain embodiments, the notch defines a first space, the first space is located between the first projection portion and the second projection portion on the same side of the central line, each row of terminals include a power terminal, and the first space and the power terminals are arranged to vertically correspond to each other.

In certain embodiments, a first protruding portion and a second protruding portion protrude outward from the lateral side of the middle shielding sheet, the first protruding portion is located in front of the second protruding portion, and the first protruding portion and the second protruding portion are exposed on a lateral side of the tongue.

In certain embodiments, the first protruding portion and the second protruding portion define a first cavity, and the first cavity is exposed on the lateral side of the tongue.

In certain embodiments, a third protruding portion protrudes outward from the lateral side of the middle shielding sheet, and the third protruding portion protrudes out of the base.

In certain embodiments, each row of terminals includes at least one ground terminal, which is located on the outermost side of the row of terminals, and the ground terminal and the middle shielding sheet form a ground loop.

In certain embodiments, the electrical connector further includes an inner metal shell, the inner metal shell is arranged around the plurality of terminals, and moreover, the inner metal shell is in electrical contact with at least one urging portion protruding from the at least one ground terminal and with the middle shielding sheet.

In certain embodiments, the inner metal shell includes an annular portion and two covering portions extending from the annular portion, the annular portion is fixed on the base, the two covering portions are arranged on the upper surface of the tongue and the lower surface of the tongue, and the upper row of terminals and the lower row of terminals are located between the two covering portions.

In certain embodiments, the insulating body has an upper insulator and a lower insulator, the upper row of terminals are embedded in the upper insulator, the lower row of terminals are embedded in the lower insulator, and the lower insulator is assembled and fixed on the upper insulator.

In certain embodiments, each row of terminals include a pair of differential signal terminals, each differential signal terminal has a conducting portion and a connecting portion extending from the conducting portion, the conducting portion and the connecting portion are arranged on the tongue, and moreover, the width of the conducting portion is larger than the width of the connecting portion.

In certain embodiments, the distance between each two neighboring conducting portions is less than the distance between each two neighboring connecting portions.

In certain embodiments, each row of terminals include two non-high-speed terminals, the two non-high-speed terminals are arranged on the tongue, and moreover, the two non-high-speed terminals are respectively arranged on two sides of the pair of differential signal terminals.

Compared with the related art, the ground terminals according to certain embodiments of the present invention directly protrude laterally or horizontally to form the urging portions to be in contact with the inner metal shell, and such a structure does not require the ground terminals to be stamped to bend to form a bent structure, and also does not require the inner metal shell to be pierced and bent to form an elastic sheet structure, so that the machining process is effectively simplified. The inner metal shell is electrically conducted with the ground terminals, so that the inner metal shell can be connected to a ground line on a circuit board through the ground terminals, the inner metal shell and the ground terminals are grounded together, so that the inner metal shell can also produce a shielding effect, thereby further reducing electromagnetic interference in the transmission of high-frequency signals by the electric connector.

Further, the front end of the middle shielding sheet of the present invention is formed with a notch, the notch overlaps the central line of the middle shielding sheet along the longitudinal direction. At least one first projection portion and at least one second projection portion extend from the notch, the first projection portion is located in front of the second projection portion, and the first projection portion is farther away from the central line than the second projection portion is, so as to ensure the opening of the notch is enlarged while the strength of the middle shielding sheet is kept. Consequently, during the insert molding for the second time, melted plastic can easily flow into the notch after flowing into a mold cavity, and then wrap the terminals and the middle shielding sheet, which is favorable for the formation of the tongue.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the invention and together with the written description, serve to explain the principles of the invention. Wherever possible, the same reference numbers are used throughout the drawings to refer to the same or like elements of an embodiment.

DETAILED DESCRIPTION OF THE INVENTION

Figure 1:
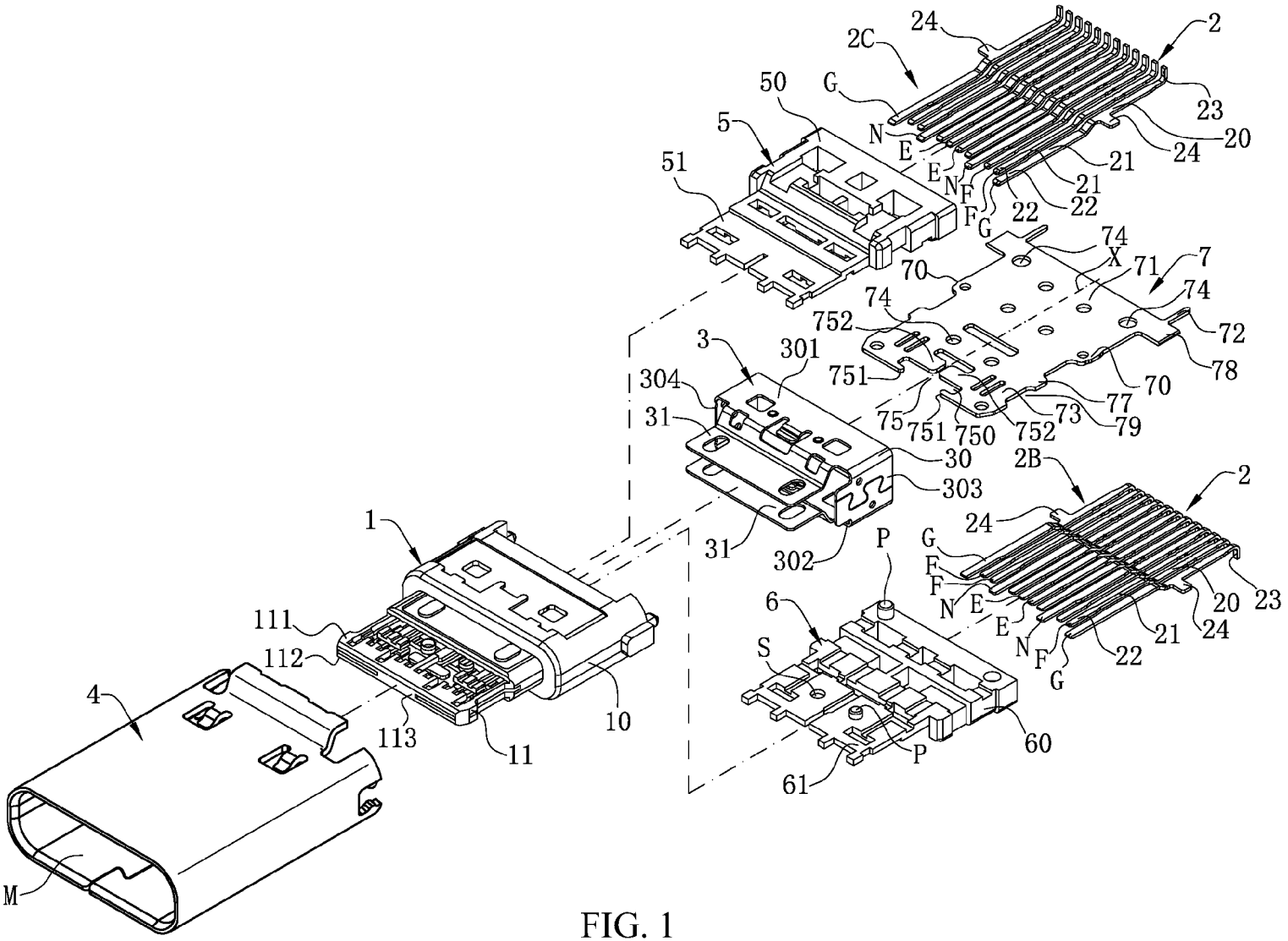
FIG. 1 is a schematic exploded view of an electrical connector according to one embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-6. In accordance with the purposes of this invention, as embodied and broadly described herein, this invention, in one aspect, relates to an electrical connector.

Figure 2:
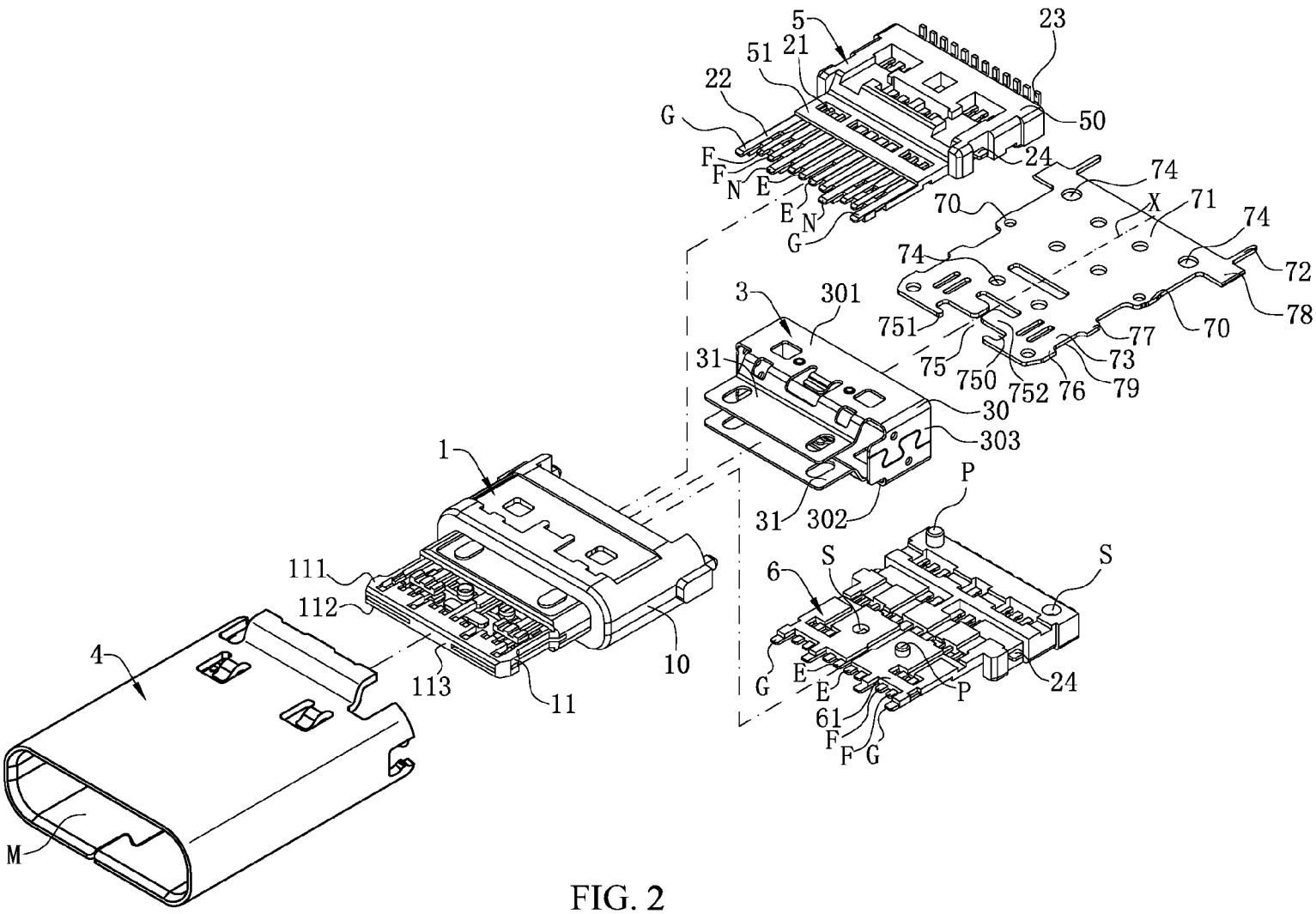
FIG. 2 is a partially exploded view of the electrical connector in FIG. 1.

As shown in FIG. 1 and FIG. 2, an electrical connector according to certain embodiments of the present invention includes an insulating body 1, multiple terminals 2 arranged in the insulating body 1, an inner metal shell 3 fixed on the insulating body 1, and an outer metal shell 4 enclosing the insulating body 1 and the inner metal shell 3 to form a mating cavity M for a mating connector (not shown) to be inserted therein.

As shown in FIG. 1 and FIG. 2, in the embodiment, the electrical connector includes an upper insulator 5, a lower insulator 6, and the insulating body 1, and the multiple terminals 2 are divided into an upper row and a lower row. The upper row of terminals 2A are insert-molded into the upper insulator 5 to form a first terminal module, the lower row of terminals 2B are insert-molded into the lower insulator 6 to form a second terminal module, and a middle shielding sheet 7 is arranged between the first terminal module and the second terminal module. After the first terminal module and the second terminal module are assembled together, the inner metal shell 3 sleeves the first terminal module and the second terminal module, insert molding is performed again to form the insulating body 1. The insulating body 1 at least partially wraps the first terminal module, the second terminal module and the inner metal shell 3.

Specifically, the upper insulator 5 has an upper base 50 and an upper tongue 51 extending forward from the upper base 50. The thickness of the upper base 50 is larger than that of the upper tongue 51. The bottoms of the upper base 50 and the upper tongue 51 are respectively provided with a positioning post P and a positioning hole S (not shown, but can refer to the corresponding structure on the lower insulator 6). Similarly, the lower insulator 6 includes a lower base 60 and a lower tongue 61 extending forward from the lower base 60. The thickness of the lower base 60 is larger than that of the lower tongue 61. The tops of the lower base 60 and the lower tongue 61 are respectively provided with a positioning post P and a positioning hole S. The positioning hole S of the lower insulator 6 correspondingly matches with the positioning post P of the upper insulator 5, the positioning hole S of the upper insulator 5 correspondingly matches with the positioning post P of the lower insulator 6, thereby assembling and fixing the upper insulator 5 and the lower insulator 6. The insulating body 1 also has a base 10 and a tongue 11 extending forward from the base 10. The tongue 11 includes an upper surface 111 and a lower surface 112, and a front surface 113 is connected to the upper surface 111 and the lower surface 112. The base 10 wraps the upper base 50 and the lower base 60, the tongue 11 completely wraps the rear parts and left and right sides of the upper tongue 51 and the lower tongue 61, and the tongue 11 also wraps the front end surfaces of the upper tongue 51 and the lower tongue 61.

Figure 3:
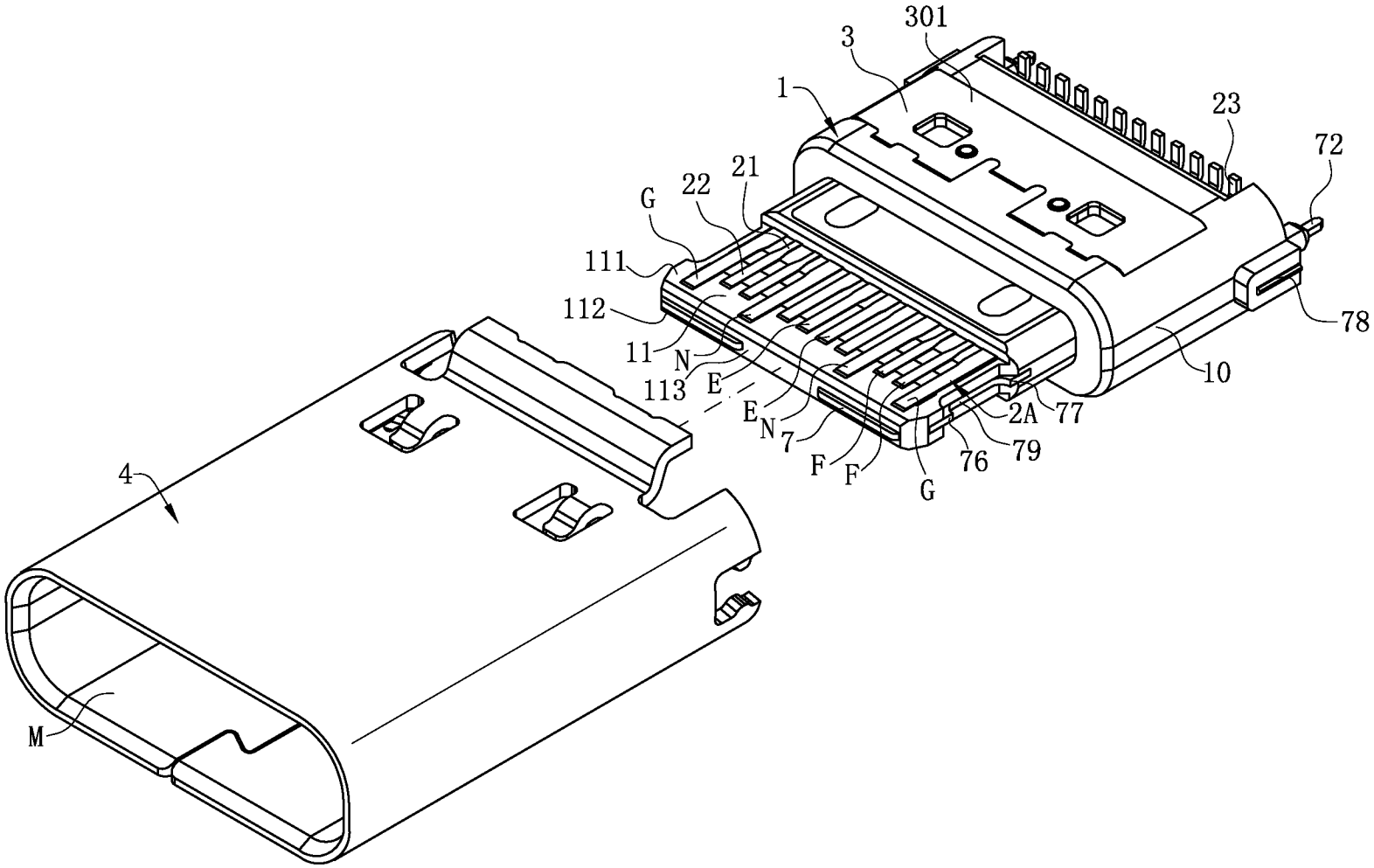
FIG. 3 is a schematic view of FIG. 2 before assembling the outer metal shell.
Figure 4:
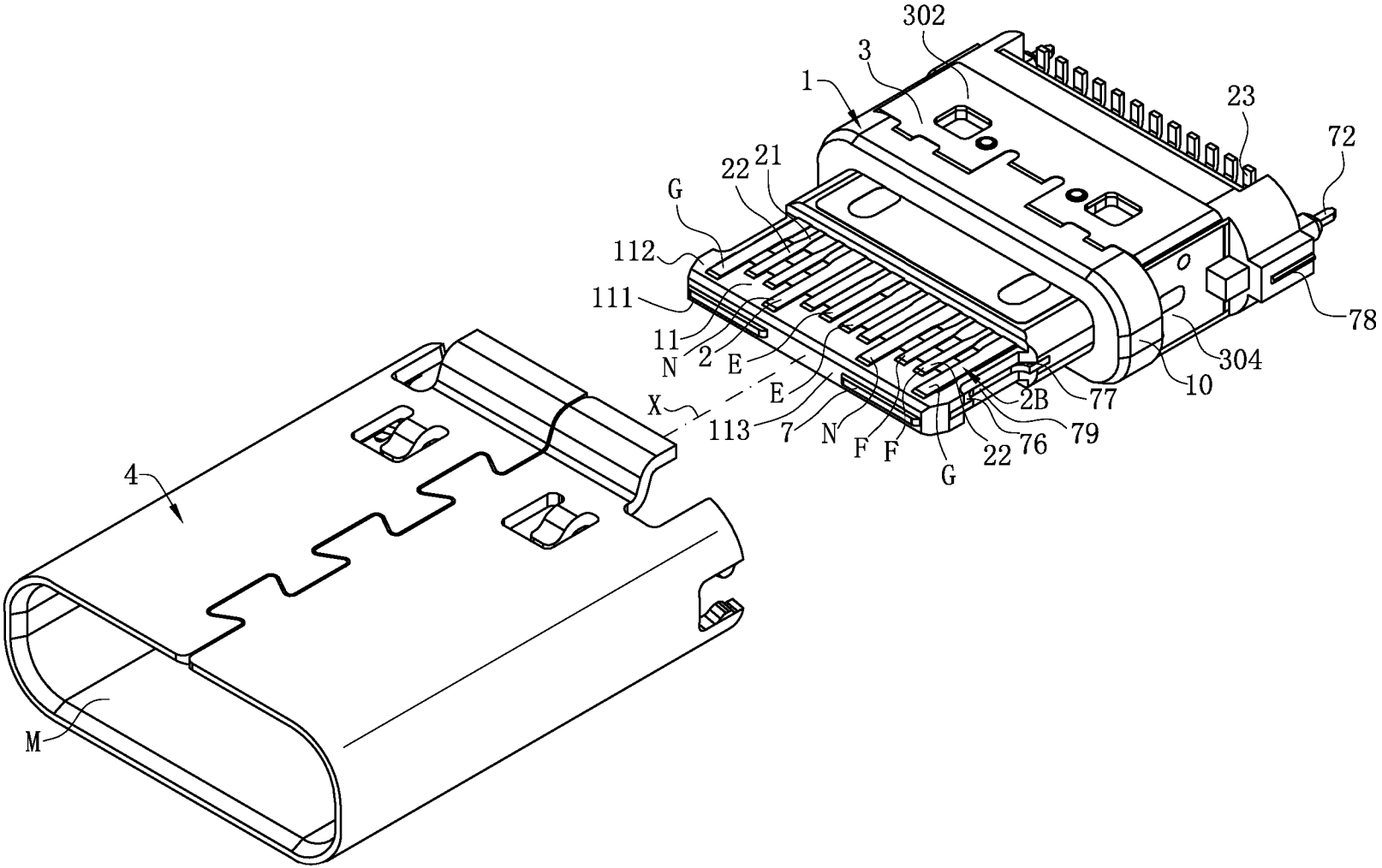
FIG. 4 is a schematic inverted view of FIG. 3.

As shown in FIGS. 2-4, a sheet metal is stamped to form the inner metal shell 3, which is embedded at least partially in the insulating body 1. The inner metal shell 3 at least partially encloses the terminals 2 and the middle shielding sheet 7. In the embodiment, the inner metal shell 3 includes an annular portion 30 fixed on the base 10 and two covering portions 31 extending forward from the annular portion 30 and respectively covering the upper and lower surfaces of the tongue 11. Specifically, the inner metal shell 3 is assembled on the first terminal module and the second terminal module. The annular portion 30 sleeves the upper base 50 and the lower base 60, and partially encloses the upper row of terminals 2A, the lower row of terminals 2B and the middle shielding sheet 7. The two covering portions 31 respectively extend forward from the top and bottom of the annular portion 30, and respectively wrap the outer surfaces of the upper tongue 51 and the lower tongue 61 so as to be located around the upper row of terminals 2A, the lower row of terminals 2B and the middle shielding sheet 7. The annular portion 30 has a top wall 301, a bottom wall 302, and a left sidewall 303 and a right sidewall 304 connected to the top wall 301 and the bottom wall 302. One sidewall 303 is buried in the base 10 of the insulating body 1, while the other sidewall 304 is exposed out of the base 10 of the insulating body 1.

Each row of terminals 2 are arranged sequentially in a left-right direction as a ground terminal G, a pair of first differential signal terminals F, a power terminal N, a reserved terminal, a pair of third signal terminals E, a reserved terminal, a power terminal N, a pair of first differential signal terminals F and a ground terminal G. A power terminal N and a ground terminal G are respectively arranged on two sides of the pair of first differential signals B. The two rows of terminals are arranged in central symmetry, so the electrical connector may be inserted in dual orientation.

A sheet metal is blanked and stamped to form the terminals 2. The structure of the lower row of terminals 2B is similar to the structure of the upper row of terminals 2A, so only the upper row of terminals 2A are taken as an example for illustration herein. Each terminal 2 among the upper row of terminals 2A has a main body 20 extending along a longitudinal direction. The main body 20 is embedded in the upper base 50, and therefore is also located in the base 10. A connecting portion 21 extends forward from the main body 20, and is embedded in the rear part of the upper tongue 51. A conducting portion 22 extends forward from the connecting portion 21, and the upper surface of the conducting portion 22 is exposed on the upper surface of the upper tongue 51, and is further exposed on the upper surface 111 of the tongue 11 in order to be in contact with the mating connector, and likewise, the conducting portions 22 of the lower row of terminals 2B are exposed on the lower surface 112 in order to be in contact with the mating connector. The front end of the conducting portion 22 is beyond the front end surface of the upper tongue 51 in order to be inserted into the front end of the tongue 11. The rear end of the main body 20 extends to go beyond the rear end surface of the upper insulator 5 and is bent to form a soldering portion 23, which is used to be soldered on a circuit board C. Among each pair of first differential signal terminals F, the width of the conducting portion 22 of each first differential signal terminal F is larger than the width of the connecting portion 21, and the distance from the conducting portion 22 of one first differential signal terminal F to the conducting portion 22 of the other first differential signal terminal F is less than the distance from the connecting portion 21 of one first differential signal terminal F to the connecting portion 21 of the other first differential signal terminal F.

Figure 5A:
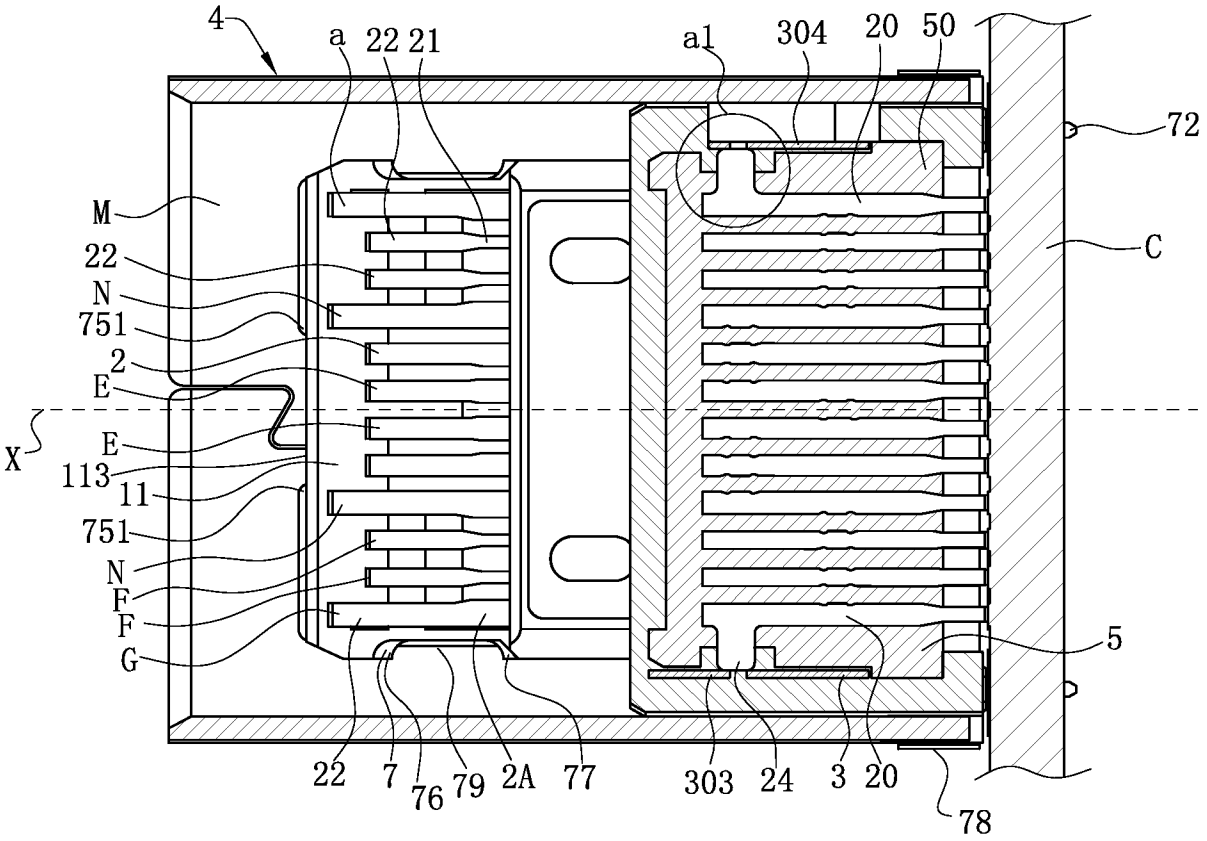
FIG. 5A is a sectional view of the plane of the upper row of terminals when the electrical connector according to one embodiment of the present invention is soldered on a circuit board.
Figure 5B:
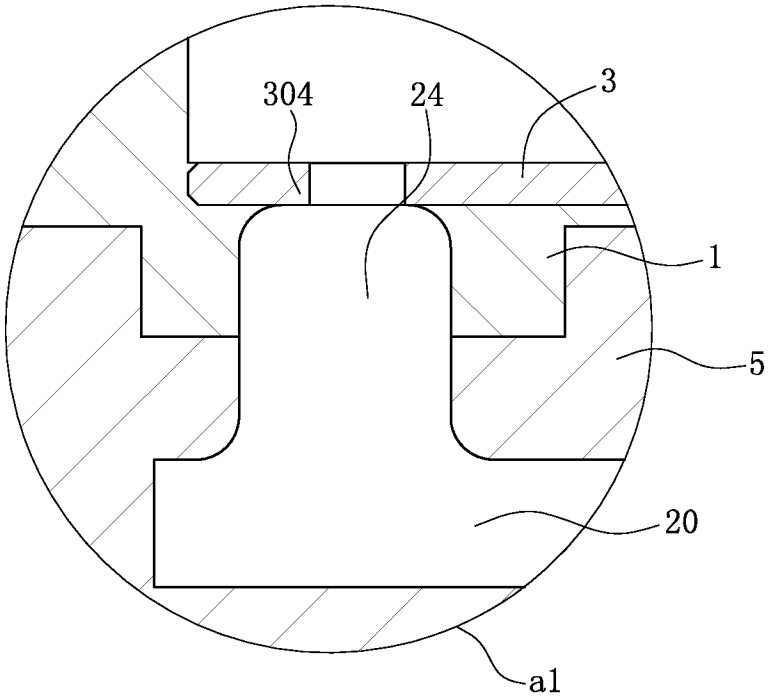
FIG. 5B is a partially enlarged view of part a1 in FIG. 5A.

As shown in FIG. 1, FIG. 5A and FIG. 5B, the outermost terminals among the upper row of terminals 2A are ground terminals G. The main body 20 of each ground terminal G further protrudes outward along the horizontal direction to form an urging portion 24. The urging portion 24 protrudes out of the upper base 50. Specifically, the urging portion 24 is of a rigid structure which is formed integrally when the sheet metal is blanked, the urging portion 24 and the main body 20 are on the same plane, but the urging portion 24 is perpendicular to the main body 20.

The urging portion 24 is located at least partially in the base 10. In the embodiment, among the two ground terminals G of the same row, the urging portion 24 of one ground terminal G is located completely in the base 10 of the insulating body 1, the plate edge thereof is in contact with the sidewall 303 embedded in the base 10 on the inner metal shell 3, and the position of contact between both is located completely in the base 10. The urging portion 24 of the other ground terminal G protrudes out of the base 10 of the insulating body 1, and the plate edge thereof is in contact with the sidewall 304 exposed out of the base 10 on the inner metal shell 3. Since each urging portion 24 is formed by protruding laterally from the main body 20 and does not have elasticity, the plate edge thereof will be in rigid contact with the inner wall of the inner metal shell 3. In order to ensure that the urging portions 24 can truly be in contact with the inner metal shell 3, the urging portions 24 are spot-welded on the inner metal shell 3, so that the reliability of contact between them is further enhanced.

Figure 6A:
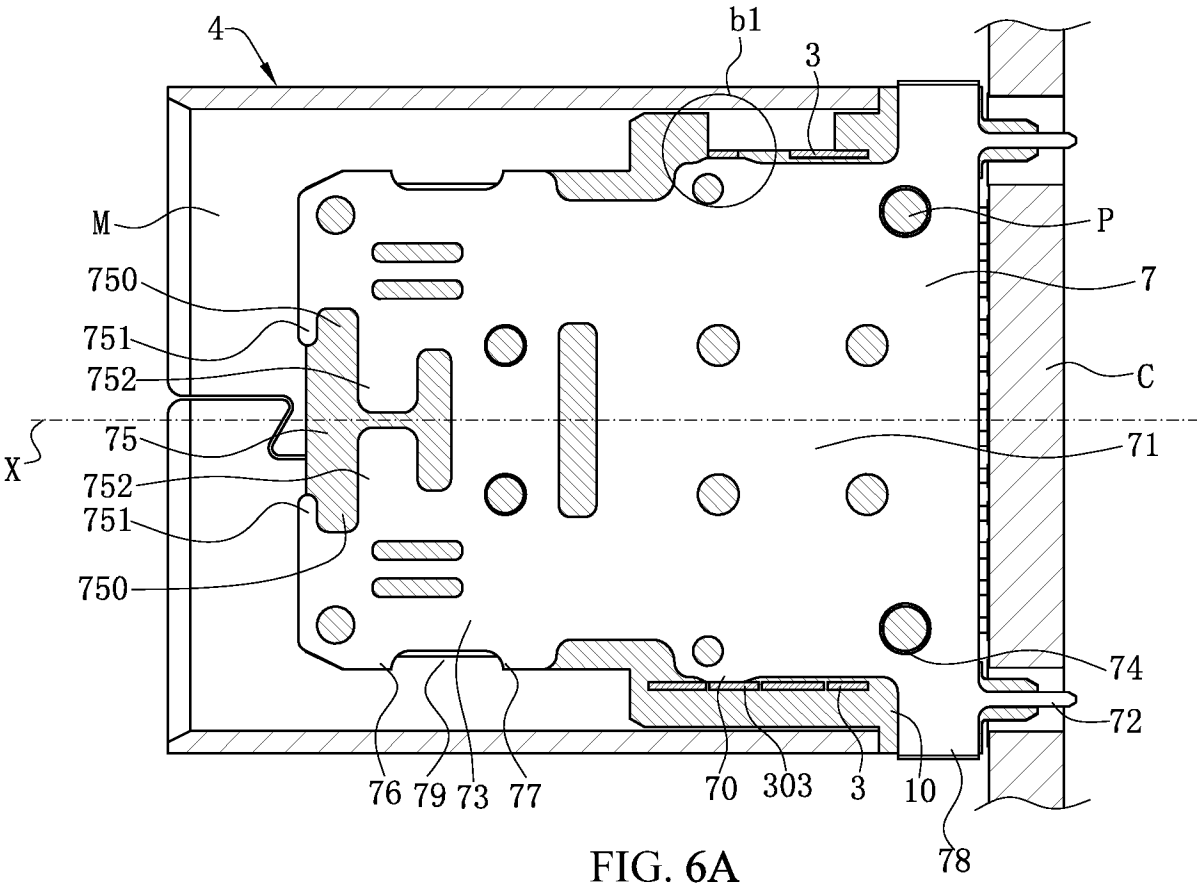
FIG. 6A is a sectional view of the plane of a middle shielding sheet in FIG. 5A.
Figure 6B:
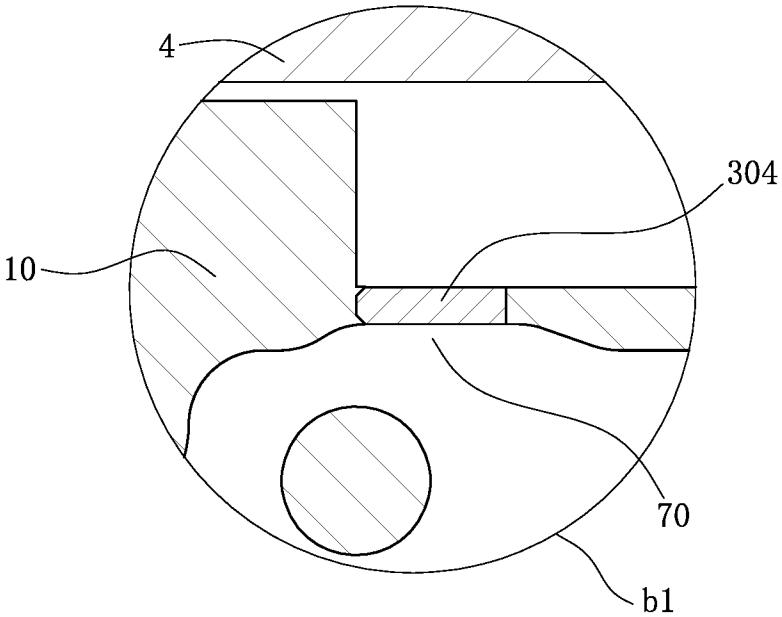
FIG. 6B is a partially enlarged view of part b1 in FIG. 6A.

As shown in FIG. 1, FIG. 6A and FIG. 6B, the middle shielding sheet 7 is disposed between the first terminal module and the second terminal module. The insulating body 1 at least partially wraps the first terminal module and the second terminal module, and the middle shielding sheet 7 has a central line X along a longitudinal direction. Both sides of the middle shielding sheet 7 respectively protrude laterally to form a contact portion 70 to be in contact with the inner metal shell 3. Specifically, a sheet metal is blanked to form the plate-like middle shielding sheet 7, which has a plate portion 71 located between the upper insulator 5 and the lower insulator 6 and embedded in the base 10. The contact portions 70 are formed by respectively horizontally protruding outward from both sides of the plate portion 71. The contact portions 70 are formed integrally when the sheet metal is blanked, and the plate edges of the contact portions urge against the inner wall of the inner metal shell 3 to be in rigid contact with the inner metal shell 3. Two third protruding portions 78 are formed by respectively horizontally protruding outward from two sides of the plate portion 71, the third protruding portions 78 are located behind the contact portions 70, and protrude and extend out of the base 10. Two plugging legs 72 extend backward from the plate portion 71 and are used to be plugged in the ground path of the circuit board C. In this way, the ground terminals G, the middle shielding sheet 7 and the inner metal shell 3 are grounded as a whole to guarantee multi-path grounding and realize a shielding effect. In addition, an extension portion 73 extends forward from the plate portion 71 and is embedded in the tongue 11 and located between the upper tongue 51 and the lower tongue 61 to shield electromagnetic interference between the upper row of terminals 2A and the lower row of terminals 2B. The plate portion 71 and the extension portion 73 are respectively provided with through holes 74 for the passage of the positioning posts P.

As shown in FIG. 1, FIG. 2 and FIG. 6A, the front surface 113 protrudes out of the front end of the extension portion 73, and the front end of the extension portion 73 is concavely provided with a notch 75. Two first projection portions 751 and two second projection portions 752 extend from the notch 75. Each of the first projection portions 751 and each of the second projection portions 752 are located in the notch 75. The notch 75 overlaps the central line X, and each of both sides of the central line X is provided with one first projection portion 751 and one second projection portion 752. The two first projection portions 751 and the two second projection portions 752 are arranged in symmetry relative to the central line X. Each of the first projection portions 751 extends from the front end of the extension portion 73 toward the central line X. Since the front end of the extension portion 73 protrudes out of the front surface 113, the first projection portions 751 extending from the front end of the extension portion 73 also protrude out of the front surface 113 to protect the tongue 11. The extending direction of the second projection portion 752 is the same as the extending direction of the first projection portions 751 on the same side, and the first projection portions 751 and the second projection portions 752 enhance the strength of the middle shielding sheet 7. Because the first projection portions 751 and the second projection portions 752 are embedded in the tongue 11, the combination area between the middle shielding sheet 7 and the tongue 11 is enlarged, and the combination between the tongue 11 and the middle shielding sheet 7 is stabilized. Further, the first projection portions 751 are located in front of the second projection portions 752, and the first projection portions 751 are closer to the central line X than the second projection portions 752 are, so that the distance between the two first projection portions 751 is larger than the distance between the two second projection portions 752, and thereby the opening of the front end of the middle shielding sheet 7 is enlarged. During the second-time insert molding, plastic in a melted state flows into the notch 75 from a space between the two first projection portions 751 after flowing into a mold cavity, and then spreads to the first terminal module and the second terminal module from the notch 75 to at least wrap the first terminal module, the second terminal module and the extension portion 73, which is favorable for the formation of the tongue 11. The plastic in the melted state passes through a space between the two second projection portions 752, thereby getting into part of the notch 75 located behind the second projection portions 752, so the combination area between the middle shielding sheet 7 and the plastic is enlarged, and the combination between the middle shielding sheet 7 and the tongue 11 is stabilized. Further, the distance between the first projection portion 751 and the second projection portion 752 located on the same side of the central line X is less than the distance from the first projection portion 751 to the central line X. The notch 75 defines two first spaces 750 located on two sides of the central line X, respectively. Each first space 750 is located between the first projection portion 751 and the second projection portion 752 located on the same side. A first protruding portion 76 and a second protruding portion 77 respectively protrude laterally from two sides of the extension portion 73. The second protruding portion 77 is located behind the first protruding portion 76, the first protruding portion 76 and the second protruding portion 77 define a first cavity 79, and the first protruding portions 76, the first cavities 79 and the second protruding portions 77 are exposed on the lateral sides of the tongue 11.

The outer metal shell 4 sleeves the insulating body 1 and the inner metal shell 3, and wraps the insulating body 1 and the inner metal shell 3. Specifically, the rear end of the outer metal shell 4 is in electric contact with the annular portion 30 of the inner metal shell 3, while the front end is a certain distance away from the tongue 11 and the covering portion 31, thereby forming the mating cavity M.

The specific manufacturing steps of the electrical connector of the present invention are as follows: firstly, the two rows of terminals, the upper insulator 5 and the lower insulator 6 mentioned above are provided, the upper insulator 5 and the upper row of terminals 2A are formed into the first terminal module by insert molding, and the lower insulator 6 and the lower row of terminals 2B are formed into the second terminal module by insert molding. Then, the middle shielding sheet 7 is arranged between the first terminal module and the second terminal module, and each positioning post P is aligned with each positioning hole S and each through hole 74, so that the first terminal module and the second terminal module are correspondingly assembled together. Then, the inner metal shell 3 is assembled on the first terminal module and the second terminal module. Then, the insulating body 1 is formed on the one-piece structure by insert molding again, and the insulating body 1 wraps the first terminal module, the second terminal module and the middle shielding sheet 7. And finally, the outer metal shell 4 is assembled.

As shown in FIG. 4, FIG. 5A and FIG. 6A, the pair of third signal terminals E among each row of terminals 2 are partially located in front of the first cavity 79, and the pair of third signal terminals E are located on both sides of the central line X and are close to the central line X. As shown in FIG. 5A, the second projection portions 752 are partially located in front of the first cavity 79, located on both sides of the central line X and are close to the central line X. And therefore, each second projection portion 752 at least partially corresponds to each third signal terminal E among the upper row of terminals 2A. Because the upper row of terminals 2A and the lower row of terminals 2B are arranged in symmetry, each second projection portion 752 at least partially corresponds to each third signal terminal E among the lower row of terminals 2B. The second projection portions 752 are at least partially located between the two rows of third signal terminals E, so that the shielding effect is enhanced, and thereby electromagnetic interference is further reduced when the electrical connector transmits signals.

As shown in FIG. 4 and FIG. 5A, observed from the top down, the power terminals N among the upper row of terminals 2A are closer to the front end of the extension portion 73 than the first cavity 79 is, the power terminals N are located behind the first projection portions 751, the first spaces 750 are closer to the front end of the extension portion 73 than the first cavity 79, and the first spaces 750 are located behind the first projection portions 751. The distance from the front end of the extension portion 73 to the first spaces 750 is less than the distance from the front end of the extension portion 73 to the power terminals N, and thereby the first spaces 750 and the power terminals N among the upper row of terminals 2A are arranged to vertically correspond to each other. The upper row of terminals 2A and the lower row of terminals 2B are arranged in symmetry, and thereby the power terminals N among the lower row of terminals 2B and the first spaces 750 are arranged to vertically correspond to each other. As can be known from FIG. 6A, the plastic enters the first spaces 750, so that the portions of the power terminals N among the upper row of terminals 2A corresponding to the first spaces 750 are insulated from the portions of the power terminals N among the lower row of terminals 2B corresponding to the first spaces 750, and thereby the terminals cannot be easily short-circuited.

In other embodiments, the electrical connector can also have only one row of terminals arranged on the insulating body 1. Among the row of terminals, the outermost terminals located at both sides are ground terminals G, and the ground terminals G rigidly urge against the inner metal shell 3 by directly protruding laterally to form urging portions 24.

The present invention have the following beneficial advantages.

1. Since the extension portion 73 protrudes out of the front surface 113, when the electrical connector and the mating connector are wrongly plugged or improperly mated, the portion of the extension portion 73 protruding out of the front surface 113 can protect the tongue 11, preventing the tongue 11 from being damaged by wrong plugging, which affects electrical connection performance.

2. Since the first projection portions 751 are located on the same sides as the second projection portions 752, and are closer to the central line X than the second projection portions 752 of the same sides. And the distance between the two first projection portions 751 is larger than the distance between the two second projection portions 752. During second-time insert molding, after flowing into the mold cavity, the plastic in the melted state flows into the notch 75 from the space between the two first projection portions 751, and then spreads to the first terminal module and the second terminal module from the notch 75 to at least wrap the first terminal module, the second terminal module and the extension portion 73, which is favorable for the formation of the tongue 11.

3. At least part of each second projection portion 752 corresponds to each third signal terminal E of each row, that is, the second projection portions 752 are at least partially located between the two rows of third signal terminals E, so that the shielding effect is enhanced, and thereby electromagnetic interference is reduced when the electrical connector transmits signals.

4. The front end of the middle shielding sheet 7 is concavely provided with the notch 75, and the notch 75 defines two first spaces 750 inside the notch 75. The first spaces 750 are arranged to vertically correspond to the power terminals N among the upper row of terminals 2A and the power terminals N among the lower row of terminals 2B. There is plastic in the first spaces 750, and consequently, the portions of the power terminals N among the upper row of terminals 2A corresponding to the first spaces 750 are insulated from the portions of the power terminals N among the lower row of terminals 2B corresponding to the first spaces 750. And thereby the terminals cannot be easily short-circuited.

5. Since the ground terminals G directly protrude laterally or horizontally to form the urging portions 24 to be in contact with the inner metal shell 3, such a structure does not require the ground terminals G to be stamped to bend to form a bent structure, and also does not require the inner metal shell 3 to be pierced and bent to form an elastic sheet structure, the machining process is effectively simplified.

6. The inner metal shell 3 is conducted electrically with the ground terminals G, so that the inner metal shell 3 can be connected to a ground line on the circuit board C through the ground terminals G. The inner metal shell 3 and the ground terminals G are grounded together, so that the inner metal shell 3 can also produce a shielding effect, thereby further reducing electromagnetic interference in the transmission of high-frequency signals by the electric connector.

7. The urging portions 24 are further connected to the inner metal shell 3 by spot welding, so the reliability of contact between both is further enhanced.

8. Both sides of the middle shielding sheet 7 respectively protrude laterally to form a contact portion 70 to be in contact with the inner metal shell 3. The contact portions 70 are formed when the sheet metal is blanked, so the machining method is simple. Moreover, the integral grounding of the ground terminals G, the middle shielding sheet 7 and the inner metal shell is realized, thereby guaranteeing multi-path grounding and realizing a shielding effect.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments are chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector, used for mating a mating connector, comprising an insulating body, having a base and a tongue extending from the base;

a plurality of terminals, fixedly disposed in the base portion in an upper row and a lower row; and a middle shielding sheet, embedded in the tongue and located between the upper row and the lower row of terminals, having a notch, concavely formed on a front end of the middle shielding sheet, and overlapping a central line of the middle shielding sheet along a longitudinal direction;

at least one first projection portion, extending from the notch; and at least one second projection portion, extending from the notch, wherein the first projection portion locates in front of the second projection portion, and the first projection portion is farther away from the central line than the second projection portion is.

2. The electrical connector of claim 1, wherein the first projection portion is located in the notch and extends from the front end of the middle shielding sheet toward the central line.

3. The electrical connector of claim 1, wherein the tongue has an upper surface;

a lower surface, arranged opposite to the upper surface; and a front surface, connected to the upper surface and the lower surface; and wherein the upper row of terminals are exposed on the upper surface, the lower row of terminals are exposed on the lower surface, and the first projection portion is exposed on the front surface.

4. The electrical connector of claim 1, wherein the at least one second projection portion comprises a plurality of second projection portions that are arranged in symmetry relative to the central line.

5. The electrical connector of claim 1, wherein each row of the upper row and the lower row of terminals include a pair of signal terminals, the at least one second projection portion comprises a plurality of second projection portions, and the second projection portions and the signal terminals are arranged to vertically correspond to each other.

6. The electrical connector of claim 1, wherein the notch defines a first space, the first space is located between the first projection portion and the second projection portion, the first projection portion and the second projection portion are located on the same side of the central line, each row of the upper row and the lower row of terminals includes a power terminal, and the first space and the power terminals are arranged to vertically correspond to each other.

7. The electrical connector of claim 1, wherein a third protruding portion protrudes outward from each side edge of the middle shielding sheet, and the third protruding portion protrudes out of the base.

8. The electrical connector of claim 1, wherein the insulating body has an upper insulator and a lower insulator, the upper row of terminals are embedded in the upper insulator, the lower row of terminals are embedded in the lower insulator, and the lower insulator is assembled and fixed on the upper insulator.

9. The electrical connector of claim 1, wherein the at least one first projection portion comprises two first projection portions that are arranged on two sides of the central line, respectively.

10. The electrical connector of claim 9, wherein a distance between each of the two first projection portions and the second projection portion is less than a distance from each of the first projection portions to the central line.

11. The electrical connector of claim 9, wherein the two first projection portions are arranged in symmetry relative to the central line.

12. The electrical connector of claim 1, wherein a first protruding portion and a second protruding portion protrude outward from each side edge of the middle shielding sheet, the first protruding portion is located in front of the second protruding portion, and the first protruding portion and the second protruding portion are exposed on a lateral side of the tongue.

13. The electrical connector of claim 12, wherein the first protruding portion and the second protruding portion define a first cavity, and the first cavity is exposed on the lateral side of the tongue.

14. The electrical connector of claim 1, wherein each row of the upper row and the lower row of terminals include at least one ground terminal located on an outermost side of the row of terminals, and the ground terminal and the middle shielding sheet form a ground loop.

15. The electrical connector of claim 14, further comprising an inner metal shell, arranged around the plurality of terminals, and in electrical contact with at least one urging portion protruding from the at least one ground terminal and with the middle shielding sheet.

16. The electrical connector of claim 15, wherein the inner metal shell comprises an annular portion, fixed on the base; and two covering portions extending from the annular portion, arranged on an upper surface of the tongue and a lower surface of the tongue; and wherein the upper row of terminals and the lower row of terminals are located between the two covering portions.

17. The electrical connector of claim 1, wherein each row of the upper row of terminals and the lower row of terminals include a pair of differential signal terminals, each differential signal terminal has a conducting portion and a connecting portion extending from the conducting portion, the conducting portion and the connecting portion are arranged on the tongue, and a width of the conducting portion is larger than a width of the connecting portion.

18. The electrical connector of claim 17, wherein a distance between each two neighboring conducting portions is less than a distance between each two neighboring connecting portions.

19. The electrical connector of claim 17, wherein each row of the upper row of terminals and the lower row of terminals include two non-high-speed terminals arranged on the tongue, and the two non-high-speed terminals are arranged on two sides of the pair of differential signal terminals, respectively.

* * * * *